US005898961A

United States Patent [19]

Ambach et al.

[11] Patent Number: 5,898,961

[45] Date of Patent: May 4, 1999

[54] MOBILE SUPPORT UNIT AND ATTACHMENT MECHANISM FOR PATIENT TRANSPORT DEVICE

[75] Inventors: Douglas C. Ambach, Cincinnati, Ohio; Timothy M. Sellers, Lawrenceburg, Ind.; Michael L. Burns, Cincinnati, Ohio; Dennis M. Lanci, Batesville, Ind.; Christopher D. Bryan, Harrison, Ohio; Stephen C. Robinson, Milford, Ohio; Joshua R. Uth, Cincinnati, Ohio

[73] Assignee: Hill-Rom, Inc.

[21] Appl. No.: 08/989,705

[22] Filed: Dec. 12, 1997

Related U.S. Application Data

[63] Continuation of application No. 08/481,036, Jun. 7, 1995, abandoned.

[51] Int. Cl.[6] ..... A47C 31/00; E05C 19/14

[52] U.S. Cl. ..... 5/600; 5/503.1; 5/658; 292/108; 292/210

[58] Field of Search ..... 5/658, 503.1, 600; 292/108, 210

[56] References Cited

U.S. PATENT DOCUMENTS

| | | |
|---|---|---|
| D. 260,816 | 9/1981 | Zissimopoulos . |
| 383,815 | 5/1888 | Kilborn . |
| 1,290,809 | 1/1919 | Traux . |
| 1,490,650 | 4/1924 | Wagner . |
| 1,919,114 | 7/1933 | Ley . |
| 2,470,524 | 5/1949 | Scudder . |
| 2,673,771 | 3/1954 | Krewson . |
| 2,696,963 | 12/1954 | Shepherd . |
| 3,004,743 | 10/1961 | Wenger . |
| 3,139,985 | 7/1964 | Sinclair . |

(List continued on next page.)

OTHER PUBLICATIONS

Eberhard Industrial and Vehicular Hardware Catalog, 1994, 1991, Eberhard Manufacturing Company, Division of The Eastern Company.

IVAC Brochure printed in USA Jul. 1989, IVAC®, 10300 Campus Point Drive, San Diego, CA 92121–1579.

LifeCare® Equipment Transport System Catalog.

The Infusion Device Transport System Brochure 1991, Travel–Med, Inc., 421 North Penn Avenue, Wilkes–Barre, PA 18702.

Pump Porter® Brochure, Mar. 1991,Pump Porter®, 3901 N. Meridian Street, Indianapolis, IN 46208.

STUR–D–GRIP Universal Critical Care Support Product Brochure, RBD Medical, Inc., P. O. Box 7756, Baltimore MD 21221.

StryKer Options/Accessories Brochure.

*Primary Examiner*—Kenneth J. Dorner
*Assistant Examiner*—Robert G. Santos
*Attorney, Agent, or Firm*—Barnes & Thornburg

[57] ABSTRACT

A mobile support unit such as an IV stand or the like coupled to a mobile hospital bed, gurney or wheelchair by a latch mechanism which provides hands free operation thereby avoiding the need for a nurse or care provider to manually manipulate the latch to secure the units together for tandem transport. Further, the latch mechanism according to this invention includes a clutch which prevents relative movement of the IV stand or support unit with respect to the hospital bed during transport up to a specific adjustable torque level thereby avoiding the problem of the IV stand or support unit swinging freely relative to the bed during movement. Further, the clutch permits movement of the IV stand or support unit through an arc relative to the bed when a specified force is applied as required by the nurse or care provider to reposition the IV stand or support unit relative to the bed and provide increased access to the patient or the like. The IV stand includes a relatively heavy base which provides a low center of gravity for the unit and offers a very stabile mobile IV stand which resists tilting or tipping during transport.

24 Claims, 8 Drawing Sheets

U.S. PATENT DOCUMENTS

| | | |
|---|---|---|
| 3,153,123 | 10/1964 | Harman . |
| 3,552,577 | 1/1971 | Latham, Jr. . |
| 3,674,294 | 7/1972 | Kirkham . |
| 3,702,940 | 11/1972 | Stewart . |
| 3,778,232 | 12/1973 | McMorrow, Jr. . |
| 3,837,665 | 9/1974 | Schramm . |
| 3,843,177 | 10/1974 | Waldo . |
| 3,899,993 | 8/1975 | Powers . |
| 3,934,807 | 1/1976 | Boutin . |
| 4,113,222 | 9/1978 | Frinzel . |
| 4,225,104 | 9/1980 | Larson . |
| 4,262,872 | 4/1981 | Kodet . |
| 4,339,104 | 7/1982 | Weidman . |
| 4,352,991 | 10/1982 | Kaufman . |
| 4,360,184 | 11/1982 | Reid, III . |
| 4,465,255 | 8/1984 | Hill . |
| 4,511,157 | 4/1985 | Wilt, Jr. . |
| 4,511,158 | 4/1985 | Varga et al. . |
| 4,513,796 | 4/1985 | Miller et al. . |
| 4,559,036 | 12/1985 | Wunsch . |
| 4,600,209 | 7/1986 | Kerr, Jr. . |
| 4,653,518 | 3/1987 | Adachi . |
| 4,678,460 | 7/1987 | Rosner . |
| 4,712,590 | 12/1987 | Gianfilippo . |
| 4,718,892 | 1/1988 | Yung-Ho . |
| 4,720,768 | 1/1988 | Schindele . |
| 4,725,027 | 2/1988 | Bekanich . |
| 4,729,576 | 3/1988 | Roach . |
| 4,738,369 | 4/1988 | Desjardins . |
| 4,747,826 | 5/1988 | Sassano . |
| 4,795,122 | 1/1989 | Petre . |
| 4,811,435 | 3/1989 | Foster et al. . |
| 4,905,944 | 3/1990 | Jost et al. . |
| 4,925,444 | 5/1990 | Orkin et al. . |
| 4,945,592 | 8/1990 | Sims et al. . |
| 4,946,439 | 8/1990 | Eggers . |
| 4,966,340 | 10/1990 | Hunter . |
| 4,993,683 | 2/1991 | Kreuzer . |
| 4,995,432 | 2/1991 | Tervamaki et al. . |
| 4,997,150 | 3/1991 | Mardollo . |
| 5,037,390 | 8/1991 | Raines et al. . |
| 5,072,906 | 12/1991 | Foster . |
| 5,094,418 | 3/1992 | McBarnes, Jr. . |
| 5,112,019 | 5/1992 | Metzler et al. . |
| 5,125,607 | 6/1992 | Pryor . |
| 5,141,210 | 8/1992 | Bauer et al. . |
| 5,167,928 | 12/1992 | Kelly et al. . |
| 5,186,337 | 2/1993 | Foster et al. . |
| 5,207,642 | 5/1993 | Orkin et al. . |
| 5,344,169 | 9/1994 | Pryor et al. . |
| 5,400,995 | 3/1995 | Boyd . |

MOBILE SUPPORT UNIT AND ATTACHMENT MECHANISM FOR PATIENT TRANSPORT DEVICE

RELATED APPLICATIONS

This application is a continuation of application Ser. No. 08/481,036, filed Jun. 7, 1995, now abandoned.

FIELD OF THE INVENTION

The present invention relates to an apparatus for transporting a medical support unit in tandem with a patient transport device such as a gurney, hospital bed, or wheelchair.

BACKGROUND OF THE INVENTION

Many hospital patients require a great deal of equipment associated with their treatment, specifically very ill patients. This equipment may include infusion pumps, intravenous (IV) solutions, critical care carts, cardiac monitors or the like. A common problem in hospitals is transporting this equipment when it is operatively connected to the patient, along with the patient over long distances through the hospital, across elevator thresholds or around hallway corners or the like. Frequently, several nurses or other care providers are required to handle the transport of the patient and the associated equipment. Nurses are required to push the bed containing the patient while other nurses push and/or control the IV stands or other support units. The number of people involved, stability of some of the equipment support units during rolling movement and movement past obstacles such as elevator thresholds have all combined to make it troublesome and difficult for the transport of the patient and connected equipment while moving the patient about the hospital.

In addition, the complexity and size of some of the support unit equipment now used for patient care results in instability of the equipment during transport and use thereof. As patient care equipment increases in size, weight, and variety, a support unit has long been needed which will conveniently and safely allow for the secure support of the equipment, its easy maneuverability for the convenience of the patient and care provider and its easy attachment and use during times of transport when the equipment is operably connected to the patient. Several techniques are currently utilized for moving patients and the related patient support equipment. As previously described, one such technique is the use of additional nurses or care providers to individually transport the associated equipment and support units. The problems associated with this technique include increased personnel requirements and the potential for interference and/or tipping of the individual units.

Another known technique is tethering the support unit to the hospital bed. Known tethering devices allow considerable motion of the towed support unit or object with respect to the hospital bed during transport. For example, there should be no movement of an IV set-up relative to the patient on the hospital bed, gurney or wheelchair to avoid disrupting the delivery of the fluid to the patient. It is important that the two vehicles be moved substantially as one unit. On the other hand, it is also advantageous that the support unit, IV stand or other towed vehicle be movable on demand by the care provider relative to the hospital bed without being disconnected therefrom. Frequently, access to the patient on the hospital bed is required during transport or while the support unit is attached to the bed and the access to the patient may require repositioning the support unit, IV stand or the like relative to the bed.

It is also important that the connecting or towing support unit be easily attached to and detached from the hospital bed, gurney, or wheelchair. The attachment/detachment of the support unit must be easily accomplished by a care provider without the requirement for complicated attachment mechanisms and difficult and time consuming manual manipulation of the attachment/detachment mechanism. Preferably, the support unit should be connected/disconnected from the hospital bed or the like without direct manual manipulation so that the care provider's hands are free to tend to the patient or maneuver the hospital bed and support unit combination during transport.

SUMMARY OF THE INVENTION

It has therefore been a primary objective of this invention to provide an improved mobile support unit for use in conjunction with a patient transport device, hospital bed or the like.

It has been a further objective to provide such a unit which is stable and will not tilt or tip during transport.

It has been a still further objective of this invention to provide such a unit which includes a mechanism for connecting to a patient transport device which offers hands free operation.

It has been a yet further objective to provide such an attachment mechanism which maintains the support unit in a set position relative to the patient transport device during transport and still permits relative movement of the unit as required by an operator.

These and other objectives of the invention have been attained by a mobile auxiliary support unit which has a relatively heavy base, typically on the order of 60–100 lbs., to provide a low center of gravity to the unit and minimize tilting and tipping of the unit during transport.

In one embodiment, the support unit comprises an IV stand having a stable heavy base weighing at least 60 pounds with a plurality of castor swivel wheels. The IV stand includes a generally vertical column projecting upwardly from the base on which a plurality of IV pole assemblies are mounted. The IV stand is stable during rolling transport due to the relatively heavy base and low center of gravity for the unit.

The present invention further includes a latch for releasably connecting the IV stand or support unit to a mobile hospital bed, gurney, wheelchair or the like. The latch permits the support unit to be selectively connected and disconnected from the hospital bed without direct manual manipulation of the latch by a care provider or nurse. Specifically, in a first presently preferred embodiment of the latch a tow arm extends from the hospital bed and carries a post. The support unit includes the latch mechanism having a hook which is resiliently biased towards an open position to permit receipt within a slot on the latch of the post. When the post on the tow arm abuts against the hook in the latch, the hook rotates and thereby captures the post. The hook pivots to a locked position and retains the post within the slot to thereby releasably connect the bed to the support unit.

A cable extends from the latch to a switch mounted conveniently on the support unit or IV stand column. Upon actuation of the switch, the cable retracts and disengages the hook from the locked position to thereby free the post from the latch and disconnect the bed from the support unit.

In a second presently preferred embodiment of the latch, the tow arm extending from the bed includes a ball on a terminal end thereof and a pair of ribs projecting on the bottom surface of the tow arm. The latch located on the support unit, IV stand or the like includes a rotor having a plurality of radial tracks projecting outwardly from a socket open upwardly at the center of the rotor. Positioned over the rotor is a keeper mechanism resiliently biased toward a locked position. When the bed and support unit are abutted into engagement, the ball on the tow arm is seated within the socket on the rotor and the pair of ribs are seated within a corresponding pair of tracks on the rotor. A trigger mechanism is provided on the latch which upon actuation enables the keeper mechanism to disengage from an open position toward the locked position and thereby capture the terminal end of the tow arm in the rotor and releasably connect the bed to the support unit. To disengage the bed from the support unit, a switch conveniently located on the support unit is actuated and via a cable disengages the keeper mechanism from the locked position and an ejector mechanism dislodges the ball from the socket and the ribs from the tracks of the rotor to propel the support unit away from the bed.

While providing hands free operation of the latch mechanism during connect and disconnect of the bed to the support unit, the latch further includes a clutch mechanism which maintains the support unit in a set position relative to the hospital bed during transport of the connected units. The clutch mechanism is selectively adjustable so as to provide a sufficient amount of torsional resistant to prevent swinging of the support unit during transport of the unit and the bed. Further, the clutch mechanism does not provide so great an amount of torsional resistance so as to prohibit manual swinging of the support unit through an arc about the bed while connected thereto as required by the care provider or the like. The clutch mechanism is adjustable to maintain the support unit at the set position relative to the bed during transport up to a torque level of about 25 to 48 foot-pounds according to a presently preferred embodiment of the invention which could be easily accomplished by a care provider or the like who intends to reposition the support unit relative to the bed.

The clutch mechanism in either embodiment of the latch according to this invention comprises a clutch pad in frictional engagement with an abutting surface to provide torsional resistance up to a specific torque level and prohibit movement of the support unit relative to the bed. However, the support unit while connected to the bed can be manually pivoted relative to the bed by applying the requisite force to overcome the frictional interface between the abutting surface and the clutch pad.

As a result, the present invention provides a stable sturdy support unit which is not likely to tip or tilt during transport and a latch mechanism which can be easily and conveniently connected/disconnected with hands free operation by the care provider and which permits movement of the support unit in an arc relative to the bed only above a selectively adjustable force level through the clutch mechanism according to this invention.

BRIEF DESCRIPTION OF THE DRAWINGS

The objectives and features of the invention will become more readily apparent from the following detailed description taken in conjunction with the accompanying drawings in which.

DETAILED DESCRIPTION OF THE INVENTION

Figure 1:
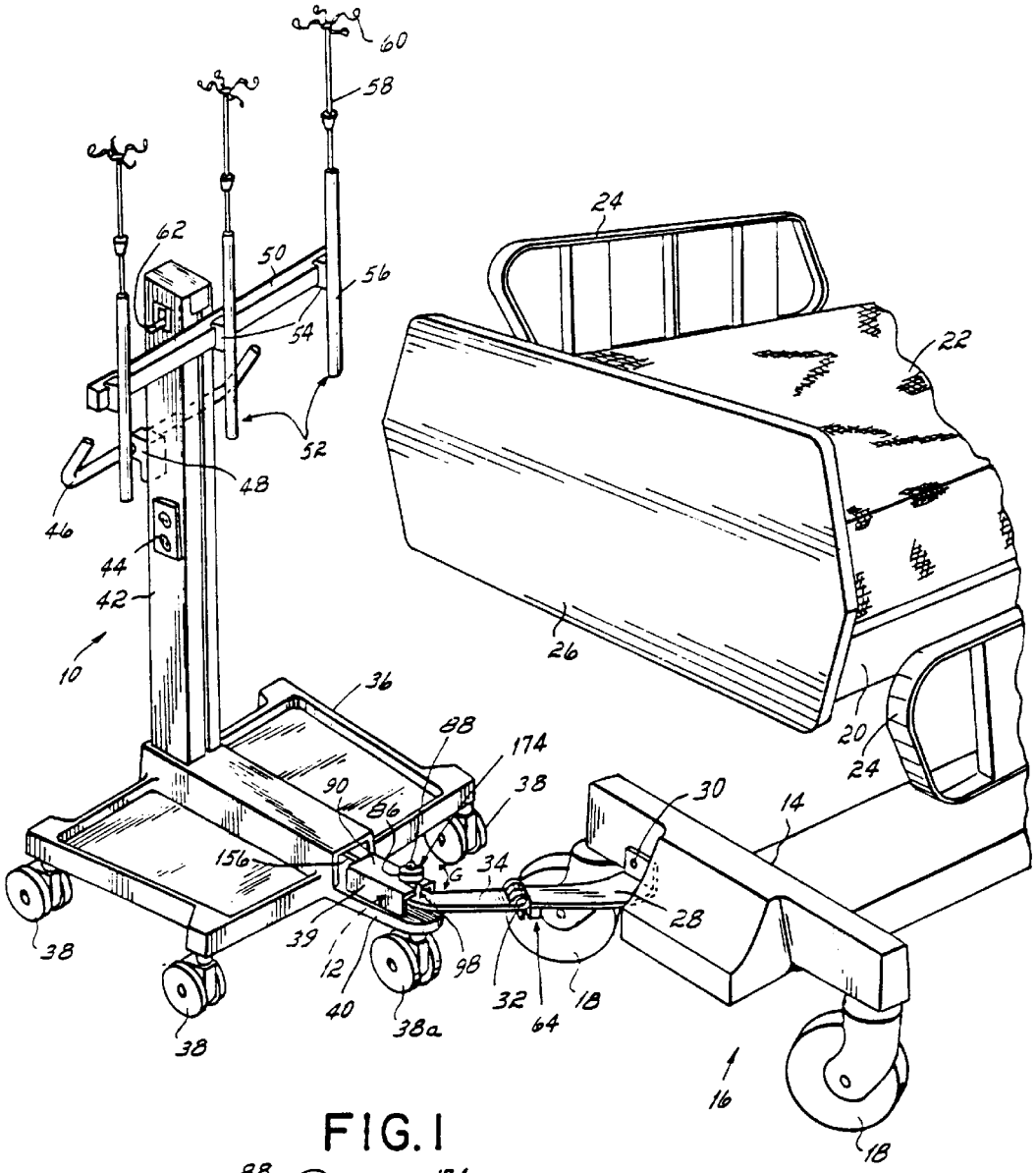
FIG. 1 is a perspective view of a mobile IV stand connected to a mobile hospital bed by a first embodiment of a latch mechanism according to the present invention.

Referring to FIG. 1, a mobile support unit is shown in the form of an IV stand 10 connected via a first preferred embodiment of a latch mechanism 12 according to this invention to a base 14 of a mobile hospital bed 16. It will be appreciated that although the support unit as shown and described herein is with reference to an IV stand that other types of support units such as a critical care cart, cardiac monitor or the like can be connected to the hospital bed according to this invention. The hospital bed 16 is a conventional mobile hospital bed with castor swivel wheels 18 supporting the base 14 of the bed 16 that includes a patient support surface 20 and a mattress 22 thereon along with side guards 24, 24 and an end board 26 to protect the patient (not shown) during transport.

Figure 2:
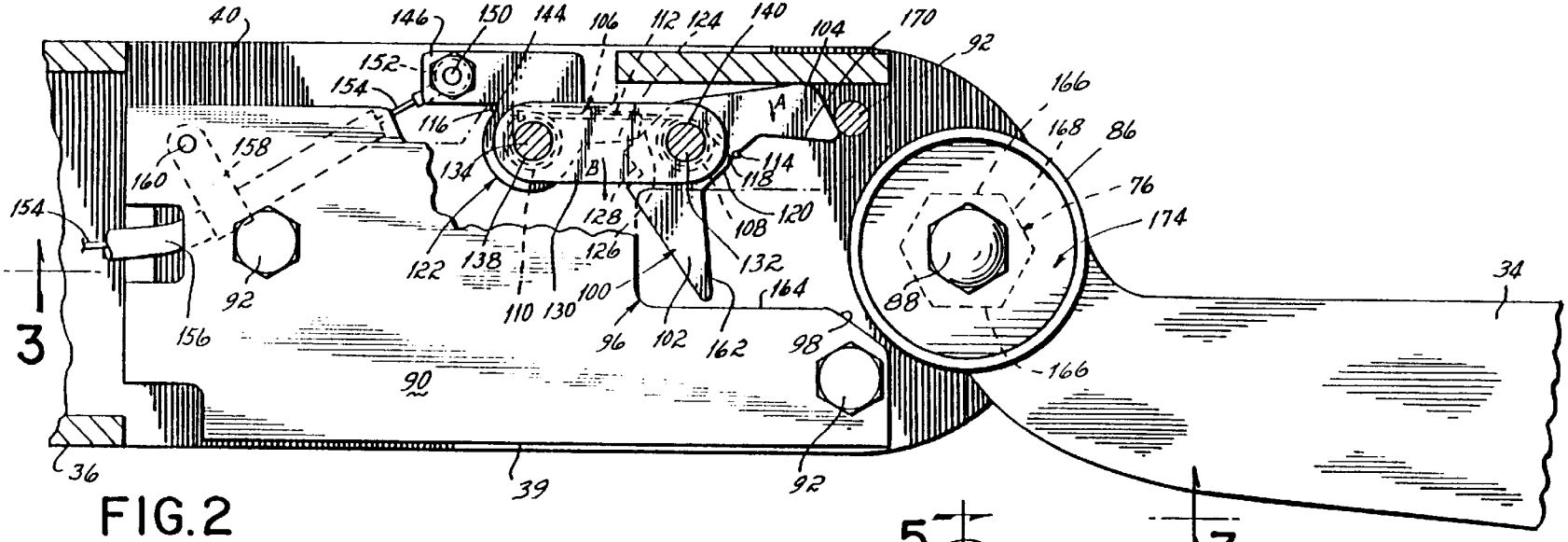
FIG. 2 is a top plan view of the first presently preferred embodiment of the latch in the open position with the approaching tow arm positioned proximate a slot of the latch.

A bracket 28 is secured by screws or other fasteners 30 to the base 14 of the bed 16 proximate one end thereof. The bed bracket 28 is pivotally coupled as by a bolt or pivot pin 32 to a tow arm 34. A distal end of the tow arm 34 is engaged within the latch 12 on the IV stand 10 as shown in FIG. 1. It will be appreciated that although a bed is shown and described herein, other mobile patient transport vehicles can be employed within the scope of this invention such as gurneys, wheelchairs or the like. Although the tow arm 34 is shown in FIG. 2 with a right handed bend proximate a distal end thereof, it will be appreciated that other configurations of the tow arm 34 are well within the scope of this invention.

The IV stand 10 includes a low profile base 36 with a plurality of castor swivel wheels 38 mounted thereon for the rolling transport of the IV stand 10. The base 36 of the IV stand 10 according to the present invention preferably weighs a minimum of 60 pounds and more preferably weighs between 60 and 100 pounds. The base 36 is relatively heavy compared to the remaining structure of the IV stand 10. As a result, the IV stand 10 has a low center of gravity which minimizes the likelihood of the stand 10 tilting or tipping during transport. Further, the stand 10 as shown in FIG. 1 includes five wheels 38 (only four of which are shown) to distribute the weight of the base 36 over a larger area and thereby provide a more stabile unit 10. Preferably, one of the wheels 38*a* is positioned proximate a tow hitch 40 on the base 36 underlying the latch mechanism 12 as shown in FIG. 1. A protective latch cover 39 encloses the latch mechanism on the support unit as shown in FIG. 1.

The IV stand 10 includes a generally vertical column 42 with an electrical outlet 44 provided on the column 42 for the provision of electricity as required. A generally U-shaped handle 46 is mounted by a bracket 48 to the column 42 and can be grasped by a care provider to maneuver the IV stand 10. A generally horizontal bar 50 is mounted on the column 42 and a plurality of IV pole assemblies 52 are attached to the horizontal bar 50 by brackets 54 as shown in FIG. 1. The IV pole assemblies 52 include a lower pole section 56 and an upper pole section 58 which is telescopingly received within the lower pole section 56 for the extension and retraction thereof. An upper end of each pole assembly includes a plurality of hooks 60 from which IV bags (not shown) can be suspended for the delivery of fluids to a patient (not shown) positioned on the bed 16. A switch 62 is mounted on the column 42 by which the latch 12 can be disengaged and the support unit or IV stand 10 disconnected from the hospital bed 16 as will be described in detail hereinbelow.

Figure 1A:
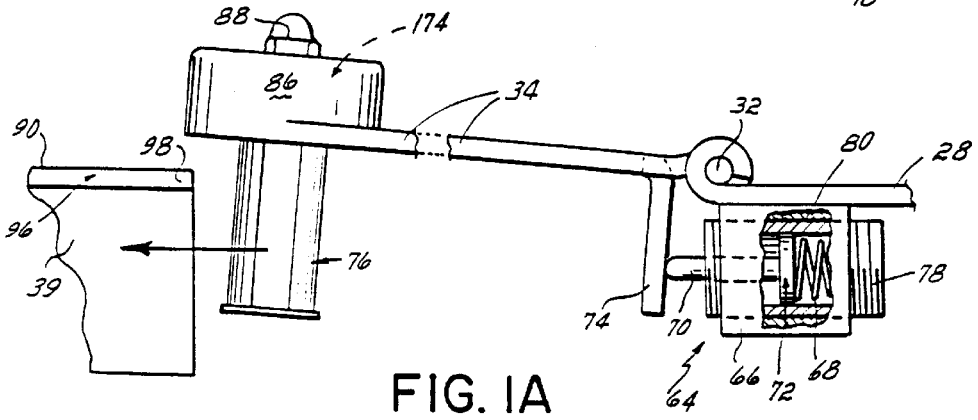
FIG. 1A is an enlarged cross-sectional view of the connection between the tow arm projecting from the base of the IV stand and a bracket projecting from the bed with a spring plunger incorporated on the bracket.

Referring to FIG. 1A, a spring plunger assembly 64 is mounted within a housing 66 on the lower surface of the bed bracket 28 proximate the tow arm 34. The spring plunger 64 includes a coil compression spring 68 which biases a stem 70 of a generally T-shaped plunger 72 outwardly from the spring plunger mechanism 64. The stem 70 of the plunger 72 abuts against the face of a downwardly bent tab 74 on an end of the tow arm 34. The spring plunger 72 biases the tow arm 34 in an upwardly canted configuration as shown in FIG. 1A to ensure that a hex post 76 on a distal end of the tow arm 34 is appropriately positioned for engagement with the latch 12 on the support unit 10 and to assist in disengagement from the latch 12. The outer surface of the plunger 72 includes threads 78 which mate with corresponding threads 80 on the inner surface of the housing 66 for selective positioning and adjustment of the stem 70 toward or away from the tow arm tab 74 by rotation of the plunger 72 relative to the housing 66 in the appropriate direction. The hexagonal shaped post 76 on a distal end of the tow arm 34 projects downwardly from the tow arm 34 and a threaded shaft 82 of the post 76 projects upwardly through a hole 84 in the tow arm 34 and through the center of a clutch housing 86 and is secured by an acorn nut 88 on an upper end thereof to the tow arm 34 and clutch housing 86.

Figure 3:
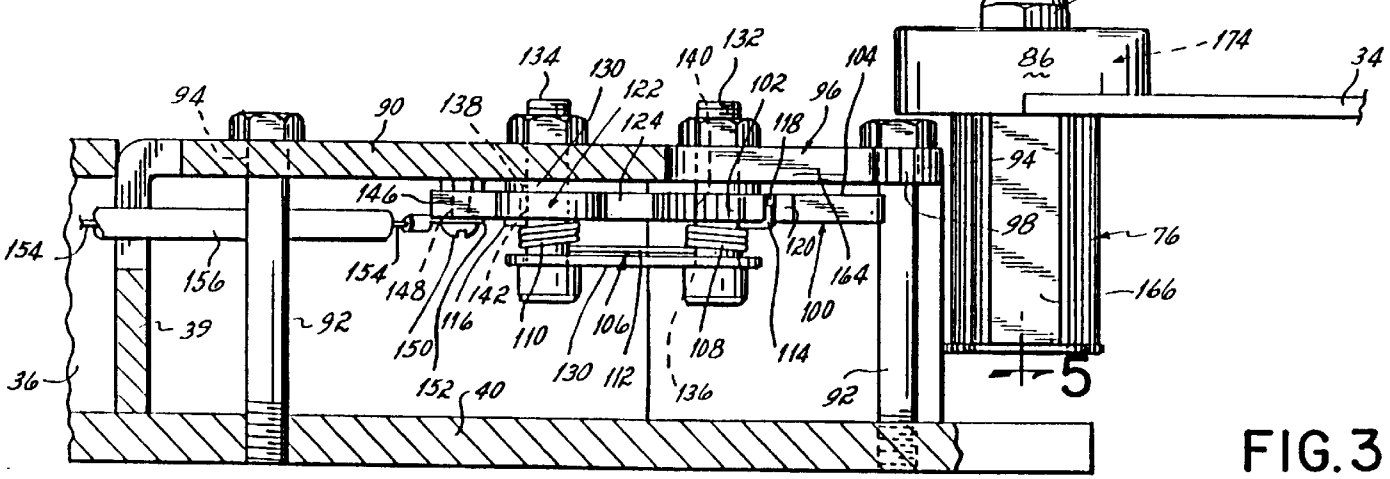
FIG. 3 is a cross-sectional view as shown along line 3—3 of FIG. 2.
Figure 4:
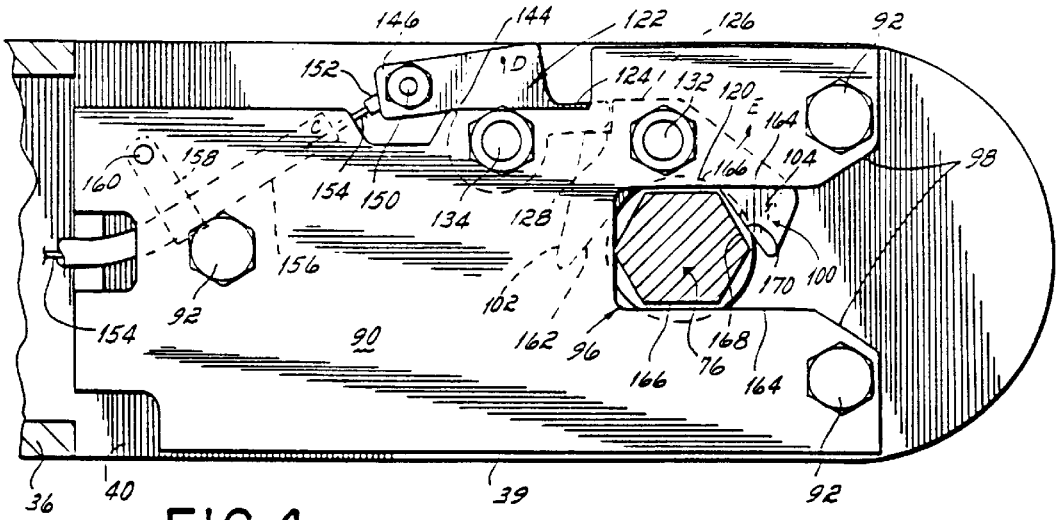
FIG. 4 is a view similar to FIG. 3 with a post of the tow arm retained within the latch mechanism in the locked position.

Referring to FIGS. 2 through 4, the first presently preferred embodiment of the latch mechanism 12 according to this invention is shown and includes the cover 39 over a generally U-shaped tow fork plate 90 which is preferably made from 1018 cold finished steel. The tow fork plate 90 is fixedly mounted to the upper surface of the tow hitch 40 projecting from the base 36 of the IV stand 10 by bolts 92 which project through holes 94 and are threadably received into the hitch 40. A generally rectangular slot 96 having a tapered mouth 98 is positioned on the upper front edge of the tow fork plate 90 as shown particularly in FIG. 2. The slot 96 is adapted to receive therein the hex post 76 which projects downwardly from the distal end of the tow arm 34. The tapered mouth 98 guides the hex post 76 into the slot 96 as the tow arm 34 and hex post 76 are abutted into the latch 12 on the IV stand 10. A bifurcated tow latch hook 100 having first and second opposing arms 102 and 104, respectively, is resiliently biased toward an open position as shown in FIGS. 2 and 3 by a latch spring 106. The latch spring 106 includes a pair of generally parallel coil sections 108, 110 joined together by a middle portion 112 of the spring 106. A clip is provided on each terminal end of the latch spring 106. The first clip 114 is seated within a crotch 118 at the bight 120 between opposing arms 102 and 104 of the bifurcated tow latch hook 100 and a second clip end 116 is captured by a tow latch keeper 122.

The tow latch keeper 122 is mounted on the tow fork plate 90 to be in generally the same plane as the tow latch hook 100. The tow latch keeper 122 includes a lug 124 which is in an abutting engagement with a back edge 126 of the tow latch hook 100 when the latch 12 is in the open position as shown in FIGS. 2 and 3. The tow latch keeper 122 is biased toward a locked position (FIG. 4) by the latch spring 106 so that the lug 124 is maintained in contact with the back edge 126 of the tow latch hook 100 when the latch 12 is in the open position of FIGS. 2 and 3. A notch 128 is also provided at one end of the back edge 126 of the tow latch hook 100. The latch spring 106, tow latch hook 100 and tow latch keeper 122 are sandwiched between opposing separator plates 130, 130 and this assembly is mounted to the tow fork plate 90 by a first and a second shoulder bolt 132, 134. Each separator plate 130 includes a pair of holes 136, 138 which are proximate one of the respective ends of the plates. The first shoulder bolt 132 projects through one of the holes 136 in each of the separator plates 130 and through a hole 140 in the tow latch hook 100 and one of the coil sections 108 of the latch spring 106. The second shoulder bolt 134 projects through the other hole 138 in each separator plate 130 and through a hole 142 in the tow latch keeper 122 and the other coil section 110 of the latch spring 106. A lock nut is threadably received on the threads of each shoulder bolt on the upper surface of the tow fork plate to secure the assembly tow fork plate. The tow latch hook 100, tow latch keeper 122 and separator plates 130 are each preferably 1018 cold finished steel.

The clip 116 on the terminal end of the latch spring 106 proximate the tow latch keeper 122 is seated within an elbow 144 of the tow latch keeper 122. The tow latch keeper 122 also includes an arm 146 projecting rearwardly away from the slot 96 of the tow fork plate 90 and includes a hole 148 with a screw 150 projecting therethrough to secure the terminal loop 152 of a cable 154. The cable 154 extends from the tow latch keeper 122 into a sheath 156 and through the tow fork plate 90 into the base 36 of the IV stand 10 and up the column 42 and is connected to the switch 62 on the column 42. A cable clamp 158 is mounted by a screw 160 to the tow fork plate 90 to retain the cable sheath 156 in position as shown in FIG. 2.

The first arm 102 of the tow latch hook 100 projects into the slot 96 as shown in FIG. 2 with the latch 12 in the open position. As the tow arm 34 and hex post 76 approach the latch 12, the hex post 76 is guided by the tapered mouth 98 of the slot 96 toward contact with an inner edge 162 of the first arm 102 of the tow latch hook 100. The spring plunger 64 at the pivotal connection between the tow arm 34 and the bed bracket 28 maintains the hex post 76 and clutch housing 86 in a proper vertical orientation relative to the latch 12 so that there is clearance between the bottom edge of the tow arm 34 and the upper surface of the latch 12 as shown in FIG. 3.

The spacing between opposing sidewalls 164, 164 of the slot 96 is sized to snugly accommodate the hex post 76 with opposing generally planar faces 166, 168 of the hex post 76 aligned generally parallel with the sidewalls 164, 164 of the slot 96. As such, the hex post 76 is prevented from rotating within the slot 96 once positioned therein. As the hex post 76 enters the slot 96 it abuts against the inner edge 162 of the first arm 102 thereby pivoting the tow latch hook 100 in the direction of arrow A and against the bias of the latch spring 106 acting on the latch hook 100. As the hex post 76 abuts against the first arm 102, the tow latch hook 100 pivots and the notch 128 is pivoted toward the lug 124 on the tow latch keeper 122. The tow latch keeper 122 is biased toward a locked position in the direction of arrow B so that once that notch 128 is presented to the lug 124, the lug 124 is seated within the notch 128 thereby preventing reverse rotation of the tow latch hook 100 as shown in FIG. 4. As such, the latch 12 can be commonly referred to as a "slam latch" type of mechanism. As the tow latch hook 100 pivots in the direction of arrow A, the second arm 104 rotates into the slot 96 and around the hex post 76 thereby capturing the hex post 76 within the slot 96. The inner edge 170 of the second arm 104, the inner edge 162 of the first arm 102, and the bight 120 of the tow latch hook 100 are configured to snugly surround three adjacent faces 168, 172 and 166, respectively, of the hex post 76 thereby in combination with the slot sidewalls 164 securely retaining the hex post 76 in the latch 12 and preventing rotation of the post 76 relative to the latch 12 and tow fork plate 90.

After the tow latch hook 100 is pivoted in the direction of arrow A so that the lug 124 is seated within the notch 128 and the second arm 104 captures the hex post 76, the latch 12 is pivoted to a locked position as shown in FIG. 4.

Once the bed 16 and IV stand 10 are connected with the hex post 76 secured in the locked position of the latch 12 as shown in FIG. 4, the IV stand 10 and bed 16 can be transported in tandem, for example, by a nurse or care provider conveniently grasping the foot board 26 of the hospital bed 16 and pushing the bed 16 and connected IV stand 10 for transport of the bed 16 and stand 10 together.

The bed 16 can be disconnected from the IV stand 10 without direct manual manipulation of the latch 12 by actuation of the switch 62 provided on the column 42 of the IV stand 10. The cable 154 is connected to the switch 62 in a manner well-known to those skilled in the art. The cable 154 is routed from switch 62 to the tow latch keeper 122 and is connected to the tow latch keeper 122 so that when the switch 62 is actuated the cable 154 is retracted in the direction of arrow C (FIG. 4) thereby pivoting the tow latch keeper 122 in the direction of arrow D and unseating the lug 124 from the notch 128 on the tow latch hook 100. The tow latch hook 100 is thereby free to pivot and as a result of the latch spring 106 bias on the tow latch hook 100 toward the open position it rotates in the direction of arrow E to release the hex post 76 from between the arms 102, 104 of the hook 100. As the tow latch hook 100 rotates in the direction of arrow E, the first arm 102 contacts the hex post 76 and propels the hex post 76 out of the slot 96 thereby disengaging the hex post 76 and tow arm 34 from the latch 12 and IV stand 10. The hook 100 and keeper 122 are pivoted to the open position as shown in FIG. 2 for the reattachment of the bed 16 to the IV stand 10 at a subsequent time as previously described.

Figure 5:
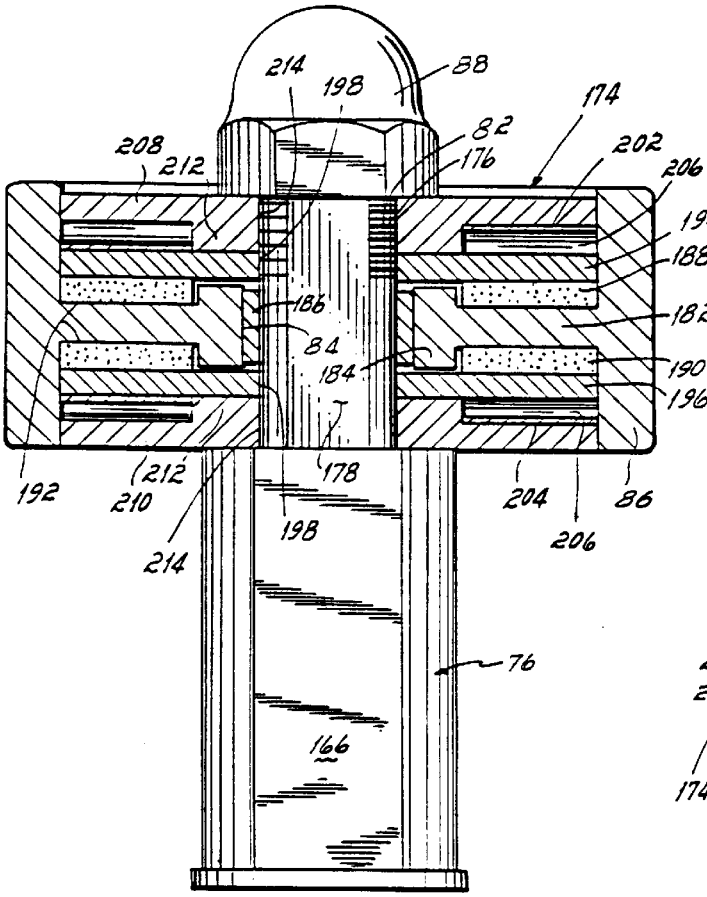
FIG. 5 is a cross-sectional view of the post and clutch mechanism according to the first preferred embodiment of the latch as viewed along line 5—5 of FIG. 3.
Figure 6:
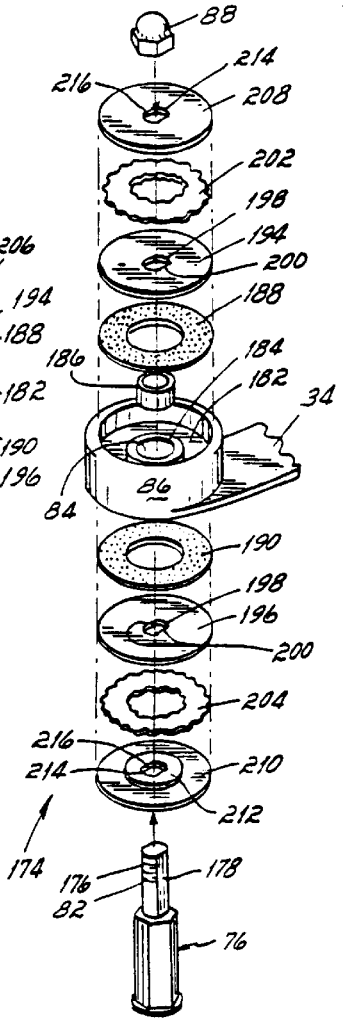
FIG. 6 is an exploded perspective view of the components of the clutch mechanism of FIG. 5.

As shown in FIGS. 5 and 6, the latch 12 according to the first presently preferred embodiment of this invention includes a clutch mechanism 174 mounted on the shaft 82 which extends upwardly from the hex post 76. An upper portion of the shaft 82 includes threads 176 to threadably receive the acorn nut 88 on an upper end thereof. The shaft 82 has a pair of opposed flattened, generally planar surfaces 178, 178. The hex post 76 and shaft 82 are preferably made from 1018 case hardened steel.

The shaft 82 as shown in FIGS. 5 and 6 projects through a center hole 84 in the clutch housing 86 preferably fabricated from 1018 cold finished steel. A ledge 182 projects inwardly from the clutch housing 86 towards a centerline thereof and is positioned approximately midway between an upper and lower edge of the clutch housing 86. A radial flange 184 is formed on an inner edge of the ledge 182 and defines the hole 84 through the center of the clutch housing 86. The shaft 82 projects through the hole 84 and the clutch mechanism components as shown in FIGS. 5 and 6. A cylindrical bearing 186, preferably fabricated from oil impregnated bronze, is seated on the shaft 82 and positioned adjacent the radial flange 184. An upper clutch pad 188 and a lower clutch pad 190 are adhesively fixed by a layer of epoxy 192 to the upper and lower surfaces, respectively, of the ledge 182 in the clutch housing 86. The clutch pads 188, 190 are preferably NF610 friction material or another appropriate organic material. The epoxy 192 secures the clutch pads 188, 190 to the clutch housing 86 to prevent movement between those parts.

An upper double-D washer 194 and a lower double-D washer 196 are positioned adjacent to the upper and lower clutch pads 188, 190, respectively. The upper and lower double-D washers 194, 196 are preferably fabricated from 1008 case hardened steel. The double-D washers 194, 196 are so named because they include a central hole 198 having a pair of opposed straight or linear edges 200, 200 which mate with the opposed flat surfaces 178, 178 of the shaft 82 to thereby prevent relative rotational movement between the shaft 82 and the double-D washers 194, 196.

An upper Bellville spring washer 202 and a lower Bellville spring washer 204 are positioned adjacent to the upper and lower double-D washers 194, 196, respectively. The Bellville spring washers 202, 204 have a generally sinusoidal shape around the circumference thereof and are preferably fabricated from spring steel. In the cross-sectional configuration shown in FIG. 5, a gap 206 between respective crests and troughs of the sinusoidal spring washer 202, 204 is present in the clutch due to the sinusoidal configuration of the Bellville spring washers 202, 204.

An upper spacer ring 208 and a lower spacer ring 210 are positioned adjacent the upper and lower Bellville washers 202, 204, respectively. The spacer rings 208, 210 are preferably fabricated from 1008 hot rolled steel. The upper and lower spacer rings 208, 210 each include a radial flange 212 which projects downwardly and upwardly, respectively, when the clutch 174 is assembled as shown in FIG. 5. The acorn nut 88 is preferably fabricated from low carbon steel. Each spacer ring 208, 210 also includes a central aperture 214 having a pair of opposed straight edges 216, 216 which are configured to mate with the opposed flat surfaces 178, 178 of the shaft 82 on the hex post 76 to thereby prevent relative rotational movement between the shaft 82 and the spacer rings 208, 210. The upper and lower spacer rings 208, 210 each have an outer circular configuration as well as each of the clutch components sandwiched therebetween so that each of these components can be seated within the circular clutch housing 86 as shown in FIGS. 5 and 6. With the respective components of the clutch 174 seated in the clutch housing 86 as shown in FIG. 5 and described herein, the acorn nut 88 is secured onto the uppermost threads 176 of the shaft 82.

The operation of the clutch 174 according to the first preferred embodiment of this invention is as follows. When the hex post 76 is maintained in the latch 12 in the locked position as shown in FIG. 4, the hex post 76 is prevented from rotating relative to the latch 12 as previously described. The clutch housing 86 integrally formed on the tow arm 34 and the clutch pads 188, 190 adhesively secured to the ledge 182 of the clutch housing 86 are inhibited from rotating relative to the hex post 76 and attached IV stand 10 due to the frictional interaction between the clutch pads 188, 190 and the double-D washers 194, 196. The acorn nut 88 is secured onto the shaft 82 and thereby applies a compressive force to the clutch 174 components to maintain intimate contact between the clutch pads 188, 190 and the double-D washers 194, 196. The further the acorn nut 88 is secured onto the shaft 82, the tighter the clutch 174 components are compacted in the clutch housing 86 and the higher the compressive force among the respective clutch mechanism components. As the compressive force increases, the Bellville spring washers 202, 204 are flattened and the gaps 206 between the crests and troughs of the Bellville spring washers 202, 204 relative to the adjacent double-D washers 194, 196 and spacer rings 208, 210 become smaller. The tighter the compression among the clutch components, the higher the frictional interaction between the clutch pads 188, 190 and the double-D washers 194, 196 become. As a result, a higher torque level is required to rotate the clutch pads 188, 190 relative to the double-D washers 194, 196 and thereby swing the support unit 10 through an arc G (FIG. 1) relative to the attached bed 16. The torque level required to overcome the frictional interaction generated between the clutch pads 188, 190 and the double-D washers 194, 196 is selectively adjustable according to this invention by tightening or loosening, as required, the acorn nut 88 on the shaft 82 of the hex post 76 and thereby increasing or decreasing, respectively, the compressive force among the clutch components as described.

Preferably, the clutch 174 according to this invention is selectively adjustable so that a torque level of between 25 to 48 foot-pounds is required to initially overcome the frictional interaction between the clutch pads 188, 190 and the double-D washers 194, 196 to swing the support unit or IV stand 10 relative to the bed 16. The torque level is sufficiently high to inhibit the IV stand or support unit 10 from moving relative to the bed 16 during transport and the IV stand or support unit remains in a set position relative to the bed 16 while being towed behind the bed 16 during transport. However, if a force is applied by a care provider, nurse or other personnel to deliver a torque level sufficient to overcome the frictional interaction among the components in the clutch 174 the IV stand 10 can be swung through the arc G of about 180° relative to the bed.

Figure 7:
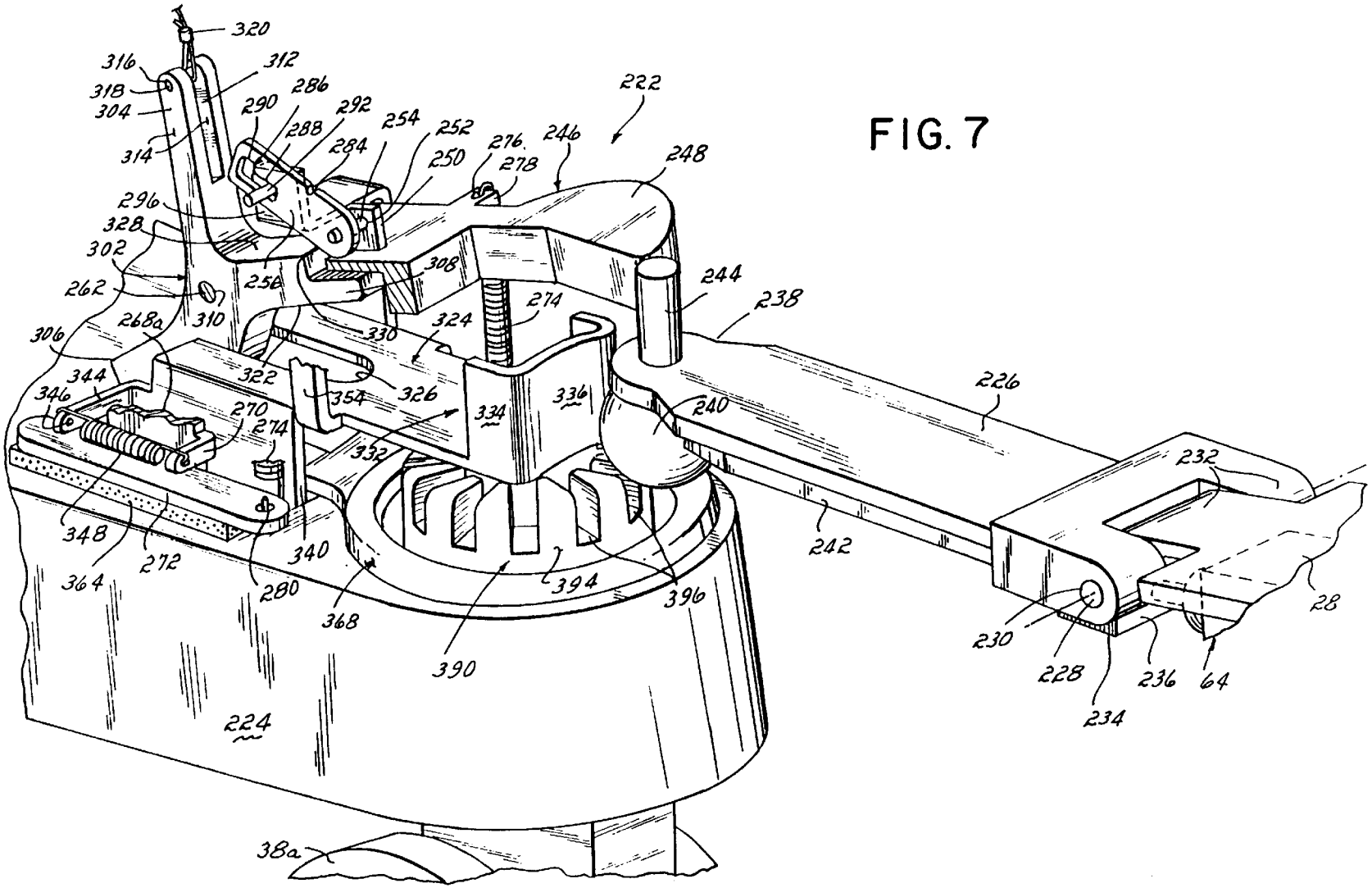
FIG. 7 is a perspective view shown partially broken away of a second presently preferred embodiment of the latch mechanism.
Figure 8:
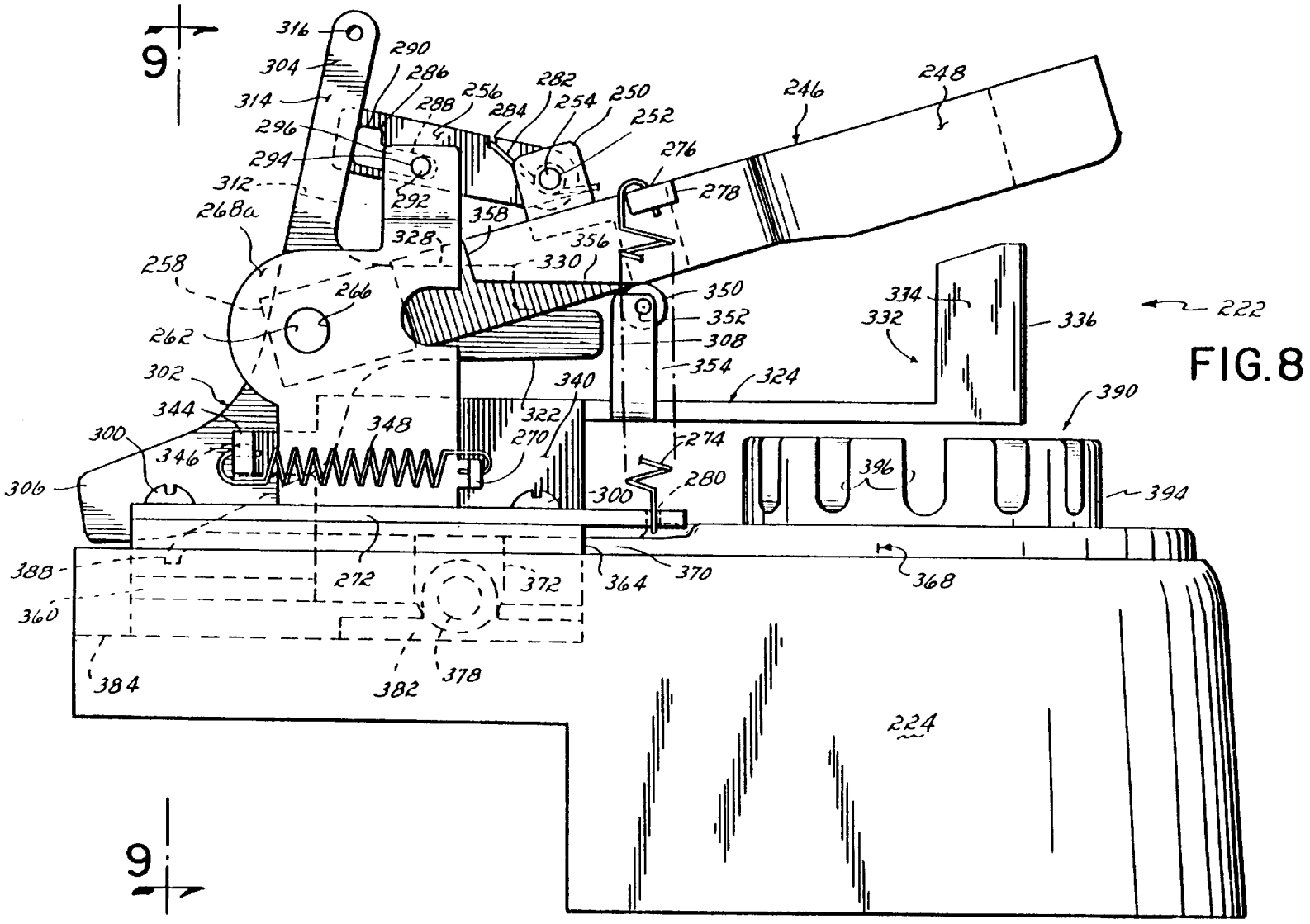
FIG. 8 is an elevational view of the second preferred embodiment of the latch mechanism in an open configuration.
Figure 9:
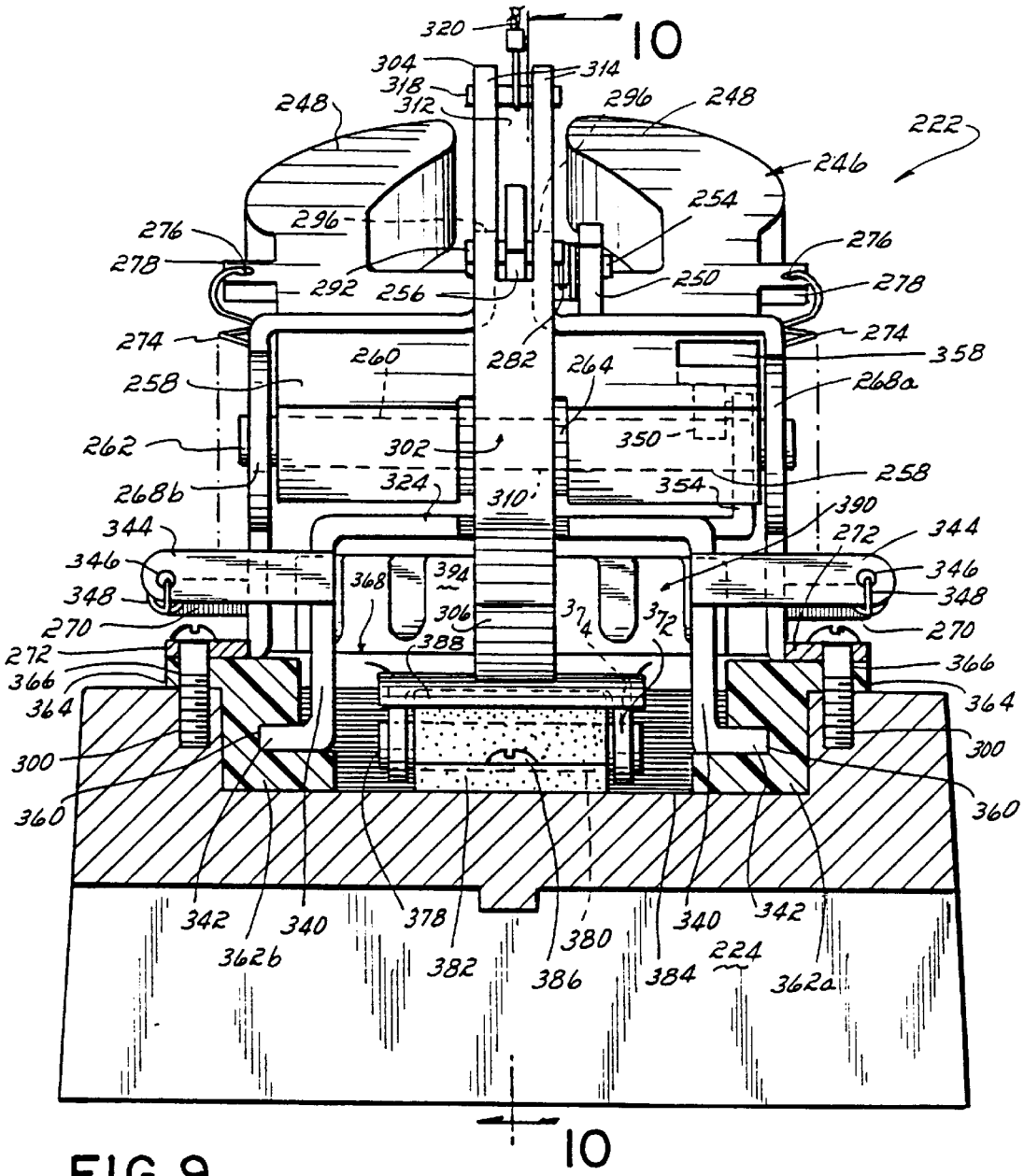
FIG. 9 is a cross-sectional view taken along line 9—9 of the latch mechanism of FIG. 8.
Figure 11:
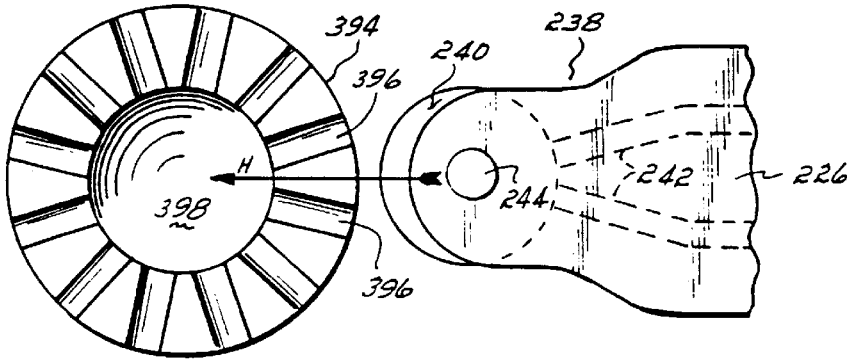
FIG. 11 is a cross-sectional view taken along line 11—11 of FIG. 10.

Referring to FIG. 7, a second presently preferred embodiment of the latch mechanism 222 according to this invention is shown. The latch 222 is positioned on a tow hitch 224 extending from the IV stand or support unit base 36. A castor swivel wheel 38*a* is mounted below the tow hitch 224 on the base 36. As with the first preferred embodiment previously described, the bed bracket 28 is secured to the base 14 of the bed 16 and has a tow arm 226 pivotally mounted as by a pin 228 which projects through holes 230 in complimentary tabs 232 at the pivotal connection between the tow arm 226 and bed bracket 28 as shown in FIG. 7. A block 234 projects downwardly from the tow arm 226 proximate the pivot connection to present an abutting surface 236 for the spring plunger mechanism 64 similar to that shown and described with reference to FIG. 1A. The tow arm 226, which is preferably made from 1018 hardened steel, has a generally planar upper surface and a narrowed neck 238 at a distal end thereof. A ball 240 is mounted on the bottom surface of the tow arm 226 at the distal end below the neck 238. A pair of ribs 242, 242 protrude from the bottom surface of the tow arm 226 and are spaced and generally parallel over the majority of the length of the tow arm 226 with the exception of the neck 238 where the ribs 242, 242 converge inwardly toward one another and terminate at the ball 240 as shown in FIG. 11. A generally cylindrical post 244 extends upwardly from the upper surface of the tow arm 226 on the narrow neck 238 proximate the distal end of the tow arm 226. The post 244 is positioned so that a longitudinal centerline thereof extends approximately through the center of the ball 240 located on the bottom surface of the tow arm 226.

The latch 222 of this preferred embodiment is located on the tow hitch 224 of the IV stand base 36 and comprises a number of subassemblies including a keeper subassembly, trigger subassembly, ejector subassembly, and clutch subassembly. The components of each of these subassemblies will now be described in detail and the operation of the latch mechanism thereafter.

The keeper subassembly includes a keeper 246 having a pair of spaced and opposed arms 248, 248 extending forwardly near an upper portion of the latch 222. The keeper 246 also includes upwardly extending tabs 250 on an upper surface thereof with each tab 250 having a through-hole 252 to receive therein a stop link pivot rod 254 secured to a stop link 256. The keeper 246 also includes a pair of lugs 258, 258 projecting rearwardly from the arms 248, 248 each of which has a generally cylindrical through-hole 260 therein to pivotally mount the keeper 246 on a keeper pivot rod 262. An opening 264 is provided between the rearwardly extending lugs 258, 258 of the keeper 246. Opposing ends of the keeper pivot rod 262 are seated within holes 266 in a pair of mounting brackets 268*a*, 268*b* each of which are mirror images of one another. Each bracket 268*a*, 268*b* also includes a generally L-shaped spring arm 270 proximate a front edge thereof which extends perpendicularly with respect to the bracket 268*a* or 268*b* and generally parallel with respect to a base 272 of each bracket 268*a*, 268*b*.

The keeper 246 is biased by a keeper spring 274 which has an upper end hooked through a hole 276 on a spring tab 278 on the keeper 246 and a lower end hooked onto a hole 280 in the base 272 of the mounting bracket 268*a*, 268*b*. The stop link 256 is biased downwardly by a torsion spring 282 which has a first end hooked into a notch 284 on the upper edge of the link 256 and is concentrically mounted on the stop link pivot rod 254 between an adjacent pair of the tabs 250 on the keeper 246. An L-shaped slot 286 having a long leg 288 and a short leg 290 is cut into the stop link 256 and is positioned proximate an end of the link 256 opposite from the pivot rod 254. A stop rod 292 projects through the slot 286 and is retained by a snap ring (not shown) at each end thereof in a hole 294 provided in an upwardly extending tab 296 on each mounting bracket 268*a*, 268*b*. Similarly, the keeper pivot rod 262 projects through the cylindrical holes 260 in the rearward lugs 258 of the keeper 246 to pivotally mount the keeper 246 relative to the brackets 268*a*, 268*b*. The base 272 of each bracket 268*a*, 268*b* is fixedly mounted as by screws 300 or the like to the tow hitch 224 on the IV stand 10.

Figure 12:
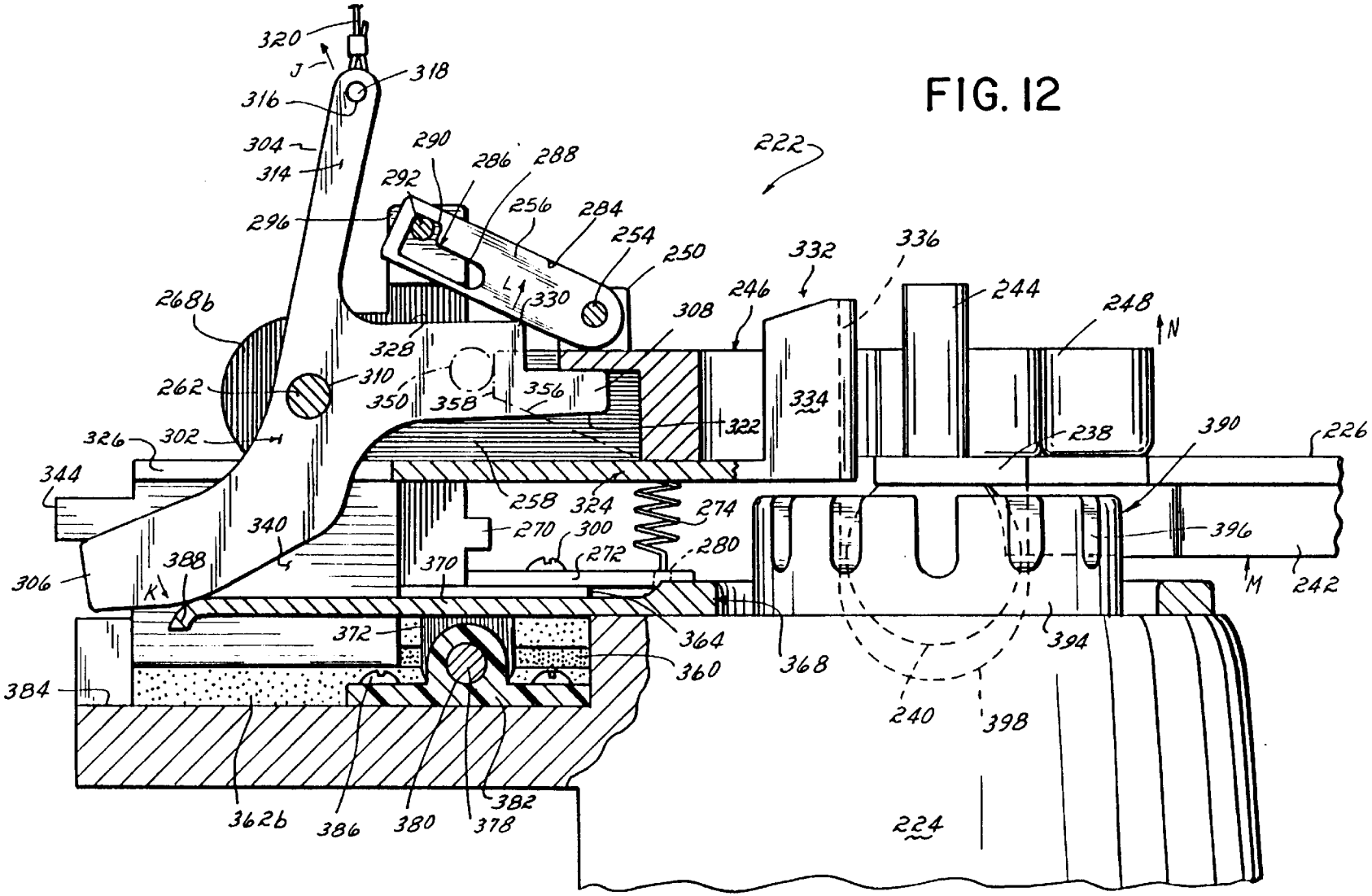
FIG. 12 is a cross-sectional view similar to FIG. 10 with the latch mechanism in the locked position and the tow arm connected thereto.

The keeper subassembly also includes a release lever 302 having three separate arms 304, 306, 308 projecting outwardly from an aperture 310 through which the keeper pivot rod 262 projects. Therefore, the release lever 302 pivots about the keeper pivot rod 262. The first arm 304 of the release lever 302 projects upwardly and is bifurcated so that the keeper stop link 256 is seated in an opening 312 between spaced prongs 314, 314 of the first arm 304. Holes 316 are provided proximate the uppermost edge of each prong 314 of the first arm 304 with a pin 318 projecting therethrough. A cable 320 is looped around the pin 318 and extends to the switch 62 on the IV stand 10 as previously described with reference to the first embodiment of the latch 12. The second arm 306 of the release lever 302 projects rearwardly and downwardly at an angle as shown particularly in FIGS. 10 and 12. The third arm 308 of the release lever 302 projects forwardly and a forwardmost bottom edge 322 of the third arm 308 rests on an upper surface of a trigger plate 324 of the trigger subassembly just forward of a slot 326 therein. An upper ledge 328 is formed on the third arm 308 of the release lever 302 and includes a corner edge 330 which contacts the bottom edge of the stop link 256 with the latch 222 in the locked position as shown in FIG. 12.

The trigger subassembly includes a trigger 332 which has a generally U-shaped upwardly extending flange 334 on a front edge thereof. A front face 336 of the flange 334 is depressed or concave. A pair of generally S-shaped flanges 340, 340 project from the opposite side edges of the trigger 332 downwardly and terminate in an out-turned lip 342 on each flange 340. Generally L-shaped spring arms 344, 344 project from the back edge of each S-shaped flange 340 proximate an upper edge thereof. A hole 346 is provided on the distal end of each spring arm 344 for one end of a trigger spring 348 to attach thereto. The trigger springs 348 bias the trigger 332 forwardly and are each attached between the spring arm 344 on the trigger 332 and the spring arm 270 on each bracket 268*a* or 268*b* of the keeper subassembly. The slot 326 is cut into the back edge of the trigger plate 324 between the S-shaped flanges 340, 340 and extends forwardly toward the U-shaped flange 334. A cam roller 350 is rotationally mounted on a pin 352 mounted on an upper edge of a cam arm 354 extending from one side of the trigger 332 forward of the S-shaped flange 340. The cam 350 is mounted for rolling contact on an aligned sloped cam surface 356 on the bottom edge of the keeper 246. The sloped cam surface 356 extends rearwardly to a shelf 358 projecting perpendicularly and upwardly from the cam surface 356.

Each out-turned lip 342 on the lower edge of each S-shaped flange 340 is seated within a channel 360 formed in a pair of trigger rails 362*a*, 362*b* of the trigger subassembly. The left and right trigger rails 362*a*, 362*b*, respectively, are provided in the latch 222 and are each preferably molded from delrin or nylon. An upper ledge 364 of each trigger rail 362*a*, 362*b* is sandwiched between the base 272 of the keeper mounting bracket 268*a*, 268*b* and the upper surface of the tow hitch 224 of the IV stand 10. Holes 366 are provided in the upper ledge 364 of each trigger rail 362*a*, 362*b* for the screws 300 which project through the base 272 of each keeper bracket 268*a*, 268*b* to secure the keeper brackets 268*a*, 268*b* and the trigger rails 362*a*, 362*b* to the tow hitch 224. The trigger 332 is preferably fabricated from 11 gage nickel plated mild steel.

The ejector subassembly is shown particularly in FIGS. 7–10 and 12 and includes an ejector ring 368 formed on the forward edge of a generally rectangular ejector plate 370. The ejector ring 368 is generally circular and has planar bottom and outer edge perimeter surfaces. The ejector ring 368 has a rounded or beveled upper edge and is preferably fabricated from 11 gage nickel plated mild steel as is the ejector plate 370. The ejector plate 370 has a pair of downwardly bent tabs 372 on opposing side edges thereof which include holes 374 through which an ejector pivot rod 378, preferably fabricated from 303 stainless steel, is inserted. The pivot rod 378 also projects through a cylindrical hole 380 in an ejector mounting block 382, preferably molded from delrin or nylon. The block 382 is mounted within a recess 384 between the trigger rails 362*a*, 362*b* and is secured as by a screw 386 or other fastener to the tow hitch 224 on the IV stand 10. The ejector ring 368 and plate 370 pivot about the pivot rod 378 relative to the ejector mounting block 382, and due to the weight distribution of the ejector ring 368 and plate 370, rest on the upper surface of the tow hitch 224 on the IV stand 10. The back edge of the ejector plate 370 is bent into a downwardly turned lip 388 and when the ejector ring 368 pivots upwardly, the lip 388 rests on the upper surface of the recess 384 in the tow hitch 224.

Figure 10:
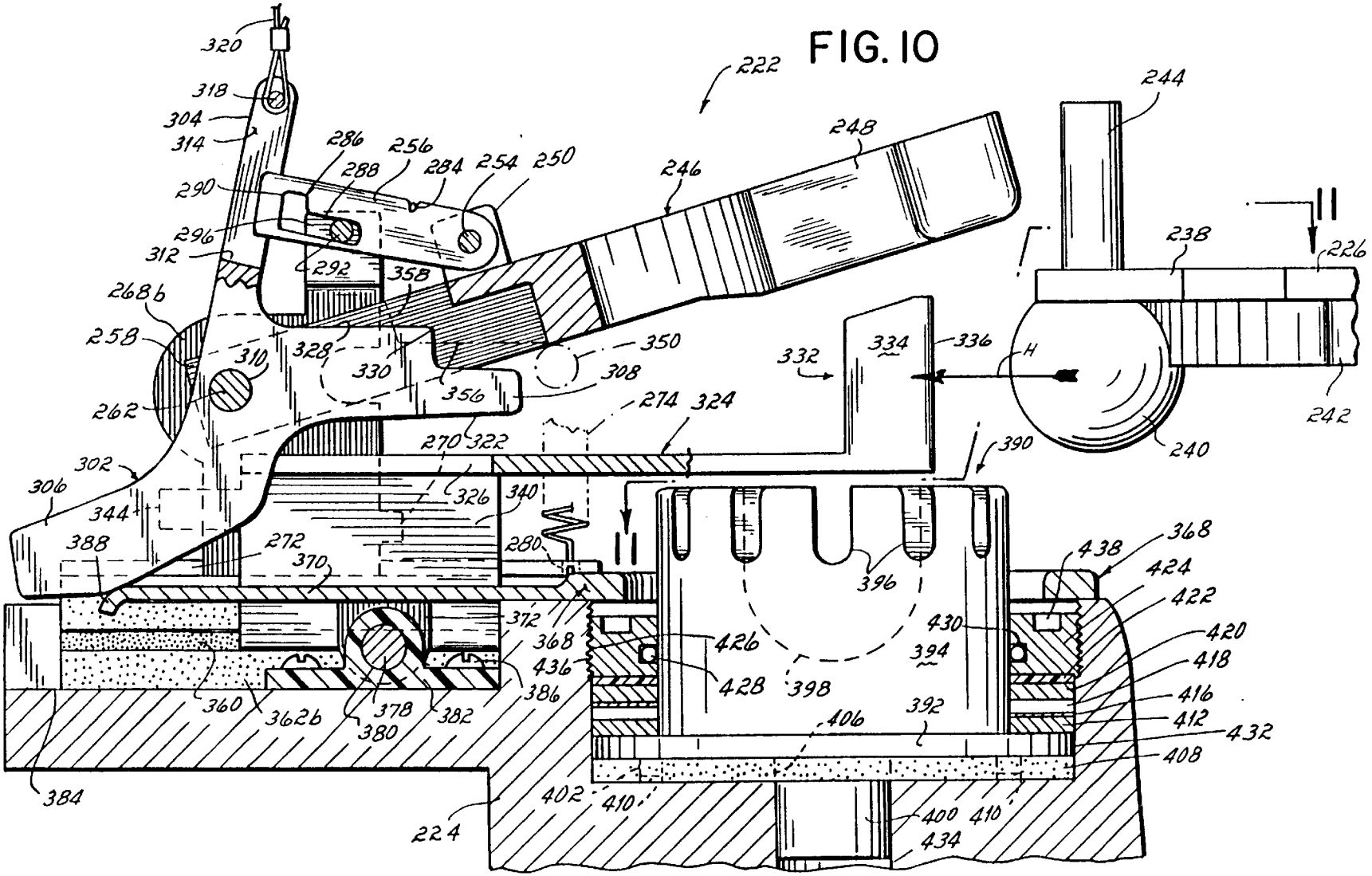
FIG. 10 is a cross-sectional view taken along line 10—10 of FIG. 9 of the latch mechanism in the open position in relation to the distal end of the tow arm projecting from the hospital bed.

The clutch subassembly is shown particularly in FIG. 10. The clutch subassembly includes a clutch rotor 390, preferably molded from verton, having a circular radial base flange 392 extending outwardly from a generally circular upwardly projecting rotor cylinder 394. A plurality of radially extending tracks 396 are molded or cut into the upper edge of the clutch rotor 390. In a preferred embodiment, twelve tracks extend radially outward from a center of the clutch rotor 390 on the upper surface thereof. A socket 398 is formed in the upper surface at the center of the clutch rotor 390 and is in communication with each of the tracks 396. A stub shaft 400 projects axially downward from the center of the bottom of the clutch rotor 390. A plurality of studs 402 are spaced radially on the bottom of the clutch rotor 390 and project downwardly.

The stub shaft 400 on the clutch rotor 390 projects through a center hole 406 in a disk shaped clutch pad 408, preferably fabricated from NF-610 material. The clutch pad 408 also includes a plurality of peripheral holes 410 which are configured and positioned to mate with the studs 402 projecting downwardly from the bottom of the clutch rotor 390. The clutch pad 408 is juxtaposed to the bottom surface of the clutch rotor 390 with the stub shaft 400 projecting through the center hole 406 and the studs 402 seated in the peripheral holes 410.

Seated on the upper surface of the radial flange 392 around the clutch rotor cylinder 394 is a lower clutch washer 412, preferably fabricated from 4140 PHT steel. Positioned atop the lower clutch washer 412 is a Bellville spring washer 416, preferably fabricated from spring steel, and includes a sinusoidal circumferential configuration which presents a gap 418 in cross-sectional configuration between the lower clutch washer 412 and an upper clutch washer 420 also preferably fabricated from 4140 PHT steel. The Bellville washer 418 is sandwiched between the upper and lower clutch washers 412, 420. Positioned atop the upper clutch washer 420 is a slip washer 422 preferably molded from delrin or nylon. Positioned atop the slip washer 422 is a clutch adjusting nut 424 having threads 426 on an outer circumferential sidewall thereof and preferably fabricated from nickel plated 4140 PHT steel. The upper and lower clutch washers 412, 420, Bellville spring washer 416, slip washer 422, and clutch adjusting nut 424 each have an enlarged center hole so that they fit around the clutch rotor cylinder 394 and rest on the radial flange 392 of the clutch rotor 390. An O-ring 428, preferably nitrile, is provided in a groove 430 on an interior sidewall of the clutch adjusting nut 424 to provide a seal between the clutch adjusting nut 424 and the clutch rotor 390.

The components of the clutch subassembly are seated within a generally cylindrical well 432 in the tow hitch 224 of the IV stand 10 as shown in FIG. 10. A sink hole 434 is cut into the center of the well 432 and is sized to receive the stub shaft 400 projecting downwardly from the clutch rotor 390. Threads 436 are provided in the sidewall of the well 432 proximate the upper edge thereof to threadably mate with the threads 426 on the perimeter sidewall of the clutch adjusting nut 424. A plurality of holes 438 are cut into the upper surface of the clutch adjusting nut 424 to receive therein a wrench (not shown) for tightening/loosening the clutch adjusting nut 424 and compressing or relieving compression, as appropriate, of the clutch slip washer 422, upper and lower clutch washers 412, 420 and Bellville spring washer 416 relative to the radial flange 392 on the clutch rotor 390. Further rotation of the clutch adjusting nut 424 compresses or relieves compression, as appropriate, of the clutch rotor 390 on the clutch pad 408. As the clutch adjusting nut 424 is rotated downwardly to compress the Bellville spring washer 416 and shorten the gap 418 between the clutch washers 412, 420, compression force is applied by the radial flange 392 on the clutch rotor 390 to the clutch pad 408 and the bottom of the well 432. This compression force and the friction between the clutch pad 408 and the adjacent components is adjustable by rotating the clutch adjusting nut 424 within the well 408.

The specific subassemblies of the second preferred embodiment of the latch 222 according to this invention have been described; the operation of the latch 222 will now be described with reference to FIGS. 7 through 12. FIGS. 7–11 show the second embodiment of the latch 222 in an open configuration with the keeper 246 held in an upwardly canted position by the cam roller 350 abutted against a forward edge of the sloped cam surface 356 on the keeper 246. The front face 336 of the U-shaped flange 334 on the trigger 332 is positioned over the socket 398 in the rotor 390 and proximate the forwardmost tracks 396 in the rotor 390. The ejector ring 368 rests generally horizontally on the upper surface of the tow hitch 224 about the rotor cylinder 394 and the stop rod 292 is positioned in the forwardmost portion of the long leg 288 of the L-shaped slot 286 in the stop link 256 as shown particularly in FIG. 7. The trigger 332 is biased forwardly by the trigger springs 348, 348 which are relaxed in a generally compressed configuration with the latch 222 in the open configuration.

To connect the IV stand 10 to the hospital bed 16 for towing and transport, the tow arm 226 is forcefully abutted against the front face 336 of the trigger 332 so that the ball contacts the concave region of the front face 336 and the post 224 extending upwardly from the tow arm 226 is positioned at a mouth of the keeper 246 between the opposing arms 248, 248. Continued movement of the tow arm 226 toward the latch 222 with the ball 240 in contact with the front face 336 of the trigger 332 forces the trigger 332 rearwardly into the latch 222 in the direction of arrow H as shown in FIGS. 7 and 10. The trigger 332 is forced rearwardly against the spring bias of the trigger springs 348, 348 thereby expanding the springs 348, 348 and translating the cam 350 from the front edge along the sloped cam surface 356 of the keeper 246. The outwardly turned lips 342, 342 on each S-shaped flange 340 of the trigger 332 translate within the channel 360 in the trigger rails 362*a*, 362*b*. When the ball 240 and the tow arm 226 forces the trigger 332 rearwardly a sufficient distance so that the cam 350 is positioned at the rearward edge of the cam surface 356, continued rearward movement of the trigger 332 pushes the cam 350 off of the rear edge of the cam surface 356 to the shelf 358 enabling the keeper 246 to pivot downwardly in the direction of its bias by the keeper springs 274, 274 and into the locked position as shown in FIG. 12. When the keeper 246 pivots downwardly, the ball 240 is seated within the socket 398 and the ribs 242 are seated within corresponding tracks 396 in the rotor 390 as shown in FIG. 12. The post 244 on the tow arm 226 advances through the mouth between the opposing arms 248, 248 and into an opening of the keeper 246. The mouth between the opposing arms 248, 248 of the keeper 246 guides the post 244 into the keeper 246 and thereby aligns the ball 240 over the socket 398 and the ribs 242 over the corresponding tracks 396 in the rotor 390.

When the keeper 246 pivots downwardly into the locked position, the stop rod 292 translates rearwardly within the L-shaped slot 286 into a locked position with the stop rod 292 seated within the shorter leg 290 of the L-shaped slot 286. The stop link 256 is biased downwardly by the stop link spring 282 thereby seating the rod 292 in the locked position in the shorter leg 290 of the L-shaped slot 286 as shown in FIG. 12. As the keeper 246 pivots downwardly toward the locked position, the corner edge 330 of the third arm 308 of the release lever 302 is engaged with the bottom edge of the stop link 256.

In the locked position shown in FIG. 12, the tow arm 226 and attached bed bracket 28 and hospital bed 16 are securely connected to the IV stand 10 and latch 222 for transport in tandem. The IV stand 10 will remain in the set position relative to the bed 16 during transport up to a specific applied force delivering a torque level to the clutch assembly. The compression of the clutch components by the clutch adjusting nut 424 being threadably mounted in the well 432 applies a compressive force to the clutch pad 408 and a frictional interface between the bottom surface of the clutch pad 408 and the bottom of the well 432 thereby inhibiting rotational movement of the clutch rotor 390 and tow arm 226 seated in the socket 398 and tracks 396 therein. The upper and lower clutch washers 412, 420 are provided to present stable firm surfaces for the Bellville washer 416 and the slip washer 422 provides a friction free interface between the clutch adjusting nut 424 and the upper clutch washer 420 to minimize the friction generated therebetween when the clutch adjusting nut 424 is rotated. As a result, the IV stand 10 will not swing relative to the hospital bed 16 and tow arm 226 until sufficient force is applied to overcome the frictional interface between the clutch pad 408 and the bottom surface of the well 432. The required torque level to move the IV stand 10 relative to the bed 16 is adjustable by screwing or unscrewing the clutch adjusting nut 424, as appropriate. In a preferred embodiment of the clutch subassembly, a torque level of between 28 and 45 foot-pounds is required to rotate the clutch pad 408 relative to the bottom surface of the well 432 and thereby pivot the IV stand 10 through an arc preferably extending about 180° relative to the hospital bed 16.

To disengage the tow arm 226 and hospital bed 16 from the rotor 390 and IV stand 10, the care provider, nurse or other personnel flips the switch 62 on the IV stand 10 thereby retracting the cable 320 connected to the first arm 304 of the release lever 302 and pivoting the release lever 302 in the direction of arrow J in FIG. 12. As the release lever 302 pivots about the keeper pivot rod 262, the second and third arms 306, 308 of the release lever likewise pivot in the directions of arrows K and L, respectively. As the second arm 306 pivots, it contacts the upper radius of the lip 388 at the rear edge of the ejector plate 370 thereby forcing the rear edge of the ejector plate 370 downwardly within the recess 384 and toward the bottom surface thereof. The ejector ring 368 pivots upwardly in the direction of arrow M so that the front edge of the ejector ring 368 contacts the bottom edge of the ribs 242 on the tow arm 226 thereby urging the tow arm 226 upwardly to dislodge the ribs 242 from the tracks 396 and the ball 240 from the socket 398. The tow arm 226 is further assisted toward upward movement for dislodging from the rotor 390 by the spring plunger 64 on the bed bracket 28 which contacts the block 234 on the tow arm 226.

The rotation of the release lever 302 about the keeper pivot rod 262 also forces the third arm 308 upwardly in the direction of arrow L so that the corner edge 330 contacts the lower edge of the stop link 256. The corner edge 330 slides rearwardly along the lower edge of the stop link 256 forcing the stop link 256 upwardly to dislodge the stop rod 292 from the locked position in the short leg 290 of the L-slot 286. Once the stop rod 292 is dislodged from the short leg 290 of the L-slot 286, the stop rod 292 is free to translate forwardly in the long leg 288 of the L-slot 286 thereby forcing the arms 248, 248 of the keeper 246 to pivot upwardly in the direction of arrow N in FIG. 12. As the keeper arms 248, 248 pivot upwardly, the expanded trigger springs 348, 348 force the trigger 332 and front face 376 thereof forwardly thereby ejecting the ball 240 and tow arm 226 which have been raised upwardly out of the socket 398 away from the latch 222 and disconnecting the bed 16 from the IV stand or support unit 10. The trigger 332 is propelled forwardly to thereby eject the tow arm 226 and ball 240 from the latch 222 and propel the IV stand 10 away from the bed 16 with an election or separation type force. When the trigger 332 advances forwardly and the tow arm 226 is ejected from the rotor 390, the latch 222 returns to the open configuration as shown in FIGS. 7–10.

From the above disclosure of the general principles of the present invention and the preceding detailed description of a preferred embodiment, those skilled in the art will readily comprehend the various modifications to which this invention is susceptible. Therefore, we desire to be limited only by the scope of the following claims and equivalents thereof.

We claim:

1. A combination comprising:

a mobile hospital bed having spaced ends and spaced first and second sides;

a mobile auxiliary support unit having a base providing a low center of gravity for said support unit to minimize tilting and tipping of said support unit during transport;

a latch means for releasably connecting said support unit to said bed proximate one of said ends thereof, said latch permitting said support unit to swing through an arc, said latch permitting said support unit to be selectively connected and disconnected from said bed without direct manual manipulation of said latch by a user's hand; and a clutch mechanism including means for providing for said support unit swinging through said arc while connected by said latch to said bed, said clutch mechanism being selectively adjustable so as to provide a sufficient amount of torsional resistance to resist swinging of said support unit during rolling of said support unit and said bed but not so great an amount of torsional resistance as to prohibit manual swinging of said support unit about said bed end by said user.

2. The combination of claim 1 further comprising:

a switch mounted on said support unit to remotely release said latch and disconnect said support unit from said bed.

3. The combination of claim 1 wherein said clutch mechanism further maintains said support unit at a set position relative to said bed during transport up to a selectively adjustable torque level of about 25 to 48 foot-pounds.

4. The combination of claim 1 wherein said latch is located proximate said base of said support unit and engages a tow arm extending from a base of said bed to thereby connect said support unit and said bed.

5. The combination of claim 1 wherein said arc is about 180°.

6. The combination of claim 1 wherein said support base is at least 60 pounds.

7. A mobile support unit for use in conjunction with a mobile hospital bed, said support unit comprising:

a base providing a low center of gravity for said support unit to minimize tilting and tipping of said support unit during transport;

a latch means for releasably connecting said support unit to said bed proximate an end of said bed, said latch permitting said support unit to swing through an arc, said latch permitting said support unit to be selectively connected and disconnected from said bed without direct manual manipulation of said latch by a user's hand; and a clutch mechanism including means for providing for said support unit swinging through said arc while connected by said latch to said bed, said clutch mechanism being selectively adjustable so as to provide a sufficient amount of torsional resistance to resist swinging of said support unit during rolling of said support unit and said bed but not so great an amount of torsional resistance as to prohibit manual swinging of said support unit about said bed end by said user.

8. The support unit of claim 7 further comprising:

a switch mounted on said support unit to remotely release said latch and disconnect said support unit from said bed.

9. The support unit of claim 7 wherein said clutch mechanism further maintains said support unit at a set position relative to said bed during transport up to a selectively adjustable torque level of about 25 to 48 foot-pounds.

10. The support unit of claim 7 wherein said latch is located proximate said base of said support unit and engages a tow arm extending from a base of said bed to thereby connect said support unit and said bed.

11. The support unit of claim 7 wherein said arc is about 180°.

12. The support unit of claim 7 wherein said support base is at least 60 pounds.

13. A mobile support unit which is attachable to an end of a mobile hospital bed to be transported in tandem with the bed and which is detachable from the hospital bed to be transported separately from the bed, the mobile support unit comprising a base, a plurality of casters mounted to the base and arranged to support the base above a floor on which the mobile support unit sets, a tow arm assembly including a tow arm couplable to the end of the hospital bed, the tow arm assembly including a post coupled to the tow arm, and a latch assembly including a fork plate mounted to the base, a hook mounted to the fork plate for pivoting movement, and a keeper mounted to the fork plate for pivoting movement, the hook having a post-engaging edge, the fork plate including a slot that receives the post, the hook being pivotable between a releasing position in which the post-engaging edge of the hook is spaced apart from the post so that the post can slide within the slot and a locking position in which the post-engaging edge engages the post so that the hook locks the post to the fork plate thereby preventing sliding and pivoting of the post within the slot, and the keeper being movable to lock the hook in the locking position.

14. The mobile support unit of claim 13, wherein the fork plate includes a first side edge, a second side edge spaced apart from the first side edge, and an end edge extending between the first and second side edges to define the slot, the post includes a first planar face and a second planar face, the first planar face of the post engages the first side edge of the fork plate and the second planar face of the post engages the second side edge of the fork plate to prevent pivoting movement of the post relative to the fork plate when the post is received by the slot formed in the fork plate.

15. The mobile support unit of claim 14, wherein the post is formed to include a third planar face adjacent to the first planar face and angled relative to the first planar face and the post-engaging edge of the hook engages the third planar face of the post when the hook is in the locking position to prevent the post from sliding within the slot.

16. The mobile support unit of claim 13, further comprising a spring coupled to the hook, coupled to the keeper, and coupled to the fork plate, the spring biasing the hook to pivot relative to the fork plate in a first direction toward the releasing position, and the spring biasing the keeper to pivot relative to the fork plate in a second direction into engagement with the hook.

17. The mobile support unit of claim 16, wherein the hook includes a notch, the keeper includes a lug, the spring biases the lug of the keeper into the notch of the hook when the hook is in the locking position, and receipt of the lug in the notch locks the hook in the locking position.

18. The mobile support unit of claim 17, further comprising a release handle coupled to the base and coupled to the keeper, the release handle being movable relative to the base to withdraw the lug of the keeper from the notch of the hook, and the spring biasing the hook into the releasing position when the lug is withdrawn from the notch.

19. The mobile support unit of claim 13, wherein the fork plate is mounted to the base in a horizontal orientation, the hook pivots relative to the fork plate about a first vertical axis, and the keeper pivots relative to the fork plate about a second vertical axis.

20. The mobile support unit of claim 13, wherein the hook includes an inner edge spaced apart from the post-engaging edge, the post engages the inner edge of the hook to pivot the hook from the releasing position in which the mobile support unit is detached from the hospital bed to the locking position in which the hook locks the post to the fork plate.

21. A mobile support unit coupled to an end of a mobile hospital bed to be transported in tandem therewith, the mobile support unit comprising a base, a plurality of casters mounted to the base and arranged to support the base above a floor on which the mobile support unit sets, a tow arm coupled to the end of the hospital bed, the tow arm being formed to include a ledge and an annular wall extending away from the ledge, the ledge being formed to include an aperture, a post extending through the aperture formed in the ledge, the post being pivotable within the aperture about an axis, the post being coupled to the base of the support unit so that the support unit can swing about the axis relative to the hospital bed, and a clutch assembly coupling the tow arm to the post to provide torsional resistance between the support unit and the hospital bed, the clutch assembly including a clutch pad fixed to the ledge of the tow arm and surrounded by the annular wall, a washer fixed to the post and surrounded by the annular wall, and a clamping assembly coupled to the post and adjustable to compress the washer against the clutch pad to change the torsional resistance of the clutch assembly, the clutch pad remaining fixed relative to the ledge and annular wall during pivoting of the post and washer about the axis.

22. A mobile support unit which is attachable to an end of a mobile hospital bed to be transported in tandem with the bed and which is detachable from the hospital bed to be transported separately from the bed, the mobile support unit comprising a base, a plurality of casters mounted to the base and arranged to support the base above a floor on which the mobile support unit sets, a tow arm coupled to the end of the hospital bed, a post coupled to the tow arm for pivoting movement about an axis, a clutch assembly coupling the tow arm to the post to provide torsional resistance between the support unit and the hospital bed, the clutch assembly including a clutch pad fixed to the tow arm, a washer fixed to the post, and a clamping assembly coupled to the post and adjustable to compress the washer against the clutch pad to change the torsional resistance of the clutch assembly, and a latch assembly including a fork plate mounted to the base, a hook mounted to the fork plate for pivoting movement, and a keeper mounted to the fork plate for pivoting movement, the fork plate including a slot that receives the post, the hook being pivotable between a releasing position in which the hook is disengaged from the post so that the post can slide within the slot and a locking position in which the hook engages the post to lock the post to the fork plate thereby preventing sliding and pivoting of the post within the slot, and the keeper engaging the hook to lock the hook is in the locking position.

23. A combination comprising:

a mobile hospital bed having spaced ends and spaced first and second sides;

a mobile auxiliary support unit having a base providing a low center of gravity for the support unit to minimize tilting and tipping of the support unit during transport;

a latch means for releasably connecting the support unit to the bed proximate one of the ends thereof, the latch means permitting the support unit to swing through an arc, the latch means permitting the support unit to be selectively connected and disconnected from the bed; and a clutch mechanism coupled to the bed, the clutch mechanism including means for providing for the support unit swinging through the arc while connected by the latch to the bed, the clutch mechanism being selectively adjustable so as to provide a sufficient amount of torsional resistance to resist swinging of the support unit during rolling of the support unit and the bed but not so great an amount of torsional resistance as to prohibit manual swinging of the support unit about the bed end by the user, the clutch mechanism remaining coupled to the bed when the mobile support unit is disconnected from the bed.

24. A combination comprising:

a mobile hospital bed having spaced ends and spaced first and second sides;

a mobile auxiliary support unit having a base providing a low center of gravity for the support unit to minimize tilting and tipping of the support unit during transport;

a latch on the support unit, the latch including means for releasably connecting the support unit to the bed proximate one of the ends thereof, the latch permitting the support unit to swing through an arc, the latch permitting the support unit to be selectively connected and disconnected from the bed without direct manual manipulation of the latch by a user's hand; and a tow arm including a post thereon, the tow arm extending from the bed;

the latch including a hook having a post-engaging edge, the hook being resiliently biased toward an open position to permit receipt in a slot in the latch the post on the tow arm, the post-engaging edge being spaced-apart from the post when the hook is in the open position, the hook being operable between the open position in which the post is moveable into and out of the slot and a locked position in which the post-engaging edge engages the post so that the post is captured and retained by the hook in the slot to thereby releasably connect the bed to the support unit.

* * * * *